US007163387B2

(12) United States Patent
Tang

(10) Patent No.: US 7,163,387 B2
(45) Date of Patent: Jan. 16, 2007

(54) MESHING HELICAL ROTORS

(75) Inventor: Yan Tang, Daphne, AL (US)

(73) Assignee: Carrier Corporation, Syracuse, NY (US)

( * ) Notice: Subject to any disclaimer, the term of this patent is extended or adjusted under 35 U.S.C. 154(b) by 136 days.

(21) Appl. No.: 10/737,408

(22) Filed: Dec. 16, 2003

(65) Prior Publication Data

US 2004/0228753 A1 Nov. 18, 2004

Related U.S. Application Data

(60) Provisional application No. 60/433,720, filed on Dec. 16, 2002.

(51) Int. Cl.
*F03C 2/00* (2006.01)
*F04C 18/00* (2006.01)

(52) U.S. Cl. ..... 418/201.3; 418/201.1

(58) Field of Classification Search ..... 418/201.3, 418/201.1

See application file for complete search history.

(56) References Cited

U.S. PATENT DOCUMENTS 3,245,612 A * 4/1966 Nilsson et al. ..... 418/201.3
4,401,420 A * 8/1983 Kasuya et al. ..... 418/201.3
4,412,796 A * 11/1983 Bowman ..... 418/201.3
4,890,992 A * 1/1990 Lee ..... 418/201.3

FOREIGN PATENT DOCUMENTS

EP 308055 A2 * 3/1989
KR 1019970122515 * 9/1997 ..... 418/201.3

* cited by examiner

*Primary Examiner*—Theresa Trieu
(74) *Attorney, Agent, or Firm*—Carlson, Gaskey & Olds

(57) ABSTRACT

A conjugate pair of intermeshing rotors include helical lobes having helical crests and intervening grooves and are adapted for rotation about parallel axes within a working space of a screw rotor machine. Each rotor has a tip circle, a pitch circle, and a root circle. One rotor of each pair is a female rotor formed such that a major portion of each lobe of the female rotor is located inside the pitch circle of the female rotor. The other rotor is a male rotor formed such that a major portion of each lobe of the male rotor is located outside the pitch circle of the male rotor. The lobes of one rotor follow the grooves of the other rotor to form a continuous sealing line between the pair of rotors. Each of the lobes have a primary flank portion and a secondary flank portion. The primary flank portion of the lobes of the female rotor have a profile formed from at least one ellipse, and the primary flank portion of the lobes of the male rotor have a profile formed from at least one ellipse.

14 Claims, 2 Drawing Sheets

MESHING HELICAL ROTORS

This application claims the benefit of the filing date of provisional application 60/433,720, having a filing date of Dec. 16, 2002.

BACKGROUND OF THE INVENTION

Screw compressors and expanders are composed of meshing screw or helical rotors. As in the case of gears, screw rotors have pitch circles which represent locations of equal tangential velocity for conjugate pairs of rotors. These spiral grooves in the rotors are the locations of the volumes of gas which are trapped and in the case of compressors, compressed due to the coaction of a conjugate pair of rotors and an enclosing casing. Accordingly, the volumes of the spiral grooves are a major design consideration, and their width, depth, length and number are important design variables. The shape of a cross section of the spiral grooves includes the variables of width and depth, as well as the shape requirements for the driving/driven coaction between the conjugate pair of rotors. Additionally, the conjugate pair of rotors must meet the sealing requirements as the line contact advances along the rotor profile in the driving/driven coaction and as the rotor tips and end faces coact with the enclosing casing. The line contact follows the perimeters of the rotor profiles and is therefore at a varying tangential speed and has significant radial components. Additionally, the shape and the cross section of the spiral grooves must meet requirements for ease of manufacture and cutting tool life. One problem associated with conventional screw rotor designs is that rotor profiles have generally been designed using a point generated and or circular profiles. These types of profiles are generally more difficult to machine, as well as exposing the rotors to more significant impact with respect to seal line length, drive band contact stress, service life, and sensitivity to temperature fluctuations.

There exists a need therefore for a screw rotor profile for reducing seal line length, reducing contact stress, increasing service life, and exhibiting more flexibility to temperature fluctuation.

SUMMARY OF THE INVENTION

It is an object of this invention to increase the efficiency and longevity of a screw machine.

It is another object of this invention to provide screw rotor profiles having a reduced blow-hole area for improved efficiency.

It is yet another object of this invention to provide improved rotor tip curves which are less sensitive to tip clearance modification and which can be used for tapered rotors.

It is a further object of this invention to achieve the disclosed performance based objects while improving the manufacturability of the screw rotor profiles.

Another object of this invention is to reduce the contact stress between the male rotor and the female rotor of a screw machine.

These objects, and others as will become apparent hereinafter, are accomplished by the present invention. The present invention provides a conjugate pair of intermeshing rotors including helical lobes having helical crests and intervening grooves that are adapted for rotation about parallel axes within a working space of a screw rotor machine. Each rotor has a tip circle, a pitch circle, and a root circle. One rotor is a female rotor formed such that a major portion of each lobe of the female rotor is located inside the pitch circle of the female rotor. The other rotor is a male rotor formed such that a major portion of each lobe of the male rotor is located outside the pitch circle of the male rotor. The lobes of one rotor follow the grooves of the other rotor to form a continuous sealing line between the pair of rotors. Each of the lobes have a primary flank portion and a secondary flank portion. The primary flank portion of the lobes of the female rotor have a profile formed from at least one ellipse, and the primary flank portion of the lobes of the male rotor have a profile formed from at least one ellipse.

BRIEF DESCRIPTION OF THE DRAWINGS

For a fuller understanding of the present invention, reference should now be made to the following detailed description thereof taken in conjunction with the accompanying drawing wherein.

DESCRIPTION OF THE PREFERRED EMBODIMENTS

Figure 1:
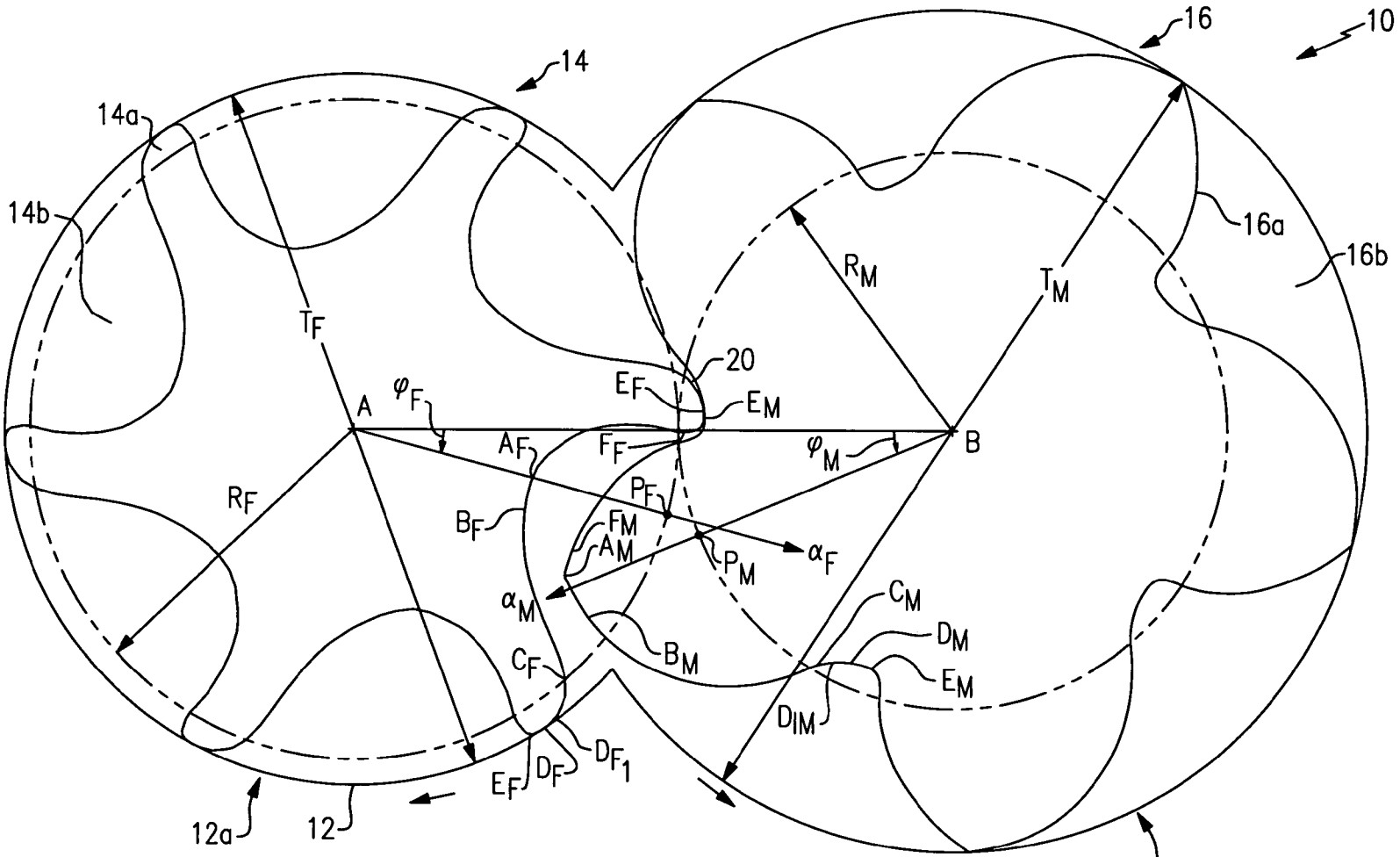
FIG. 1 is a simplified transverse section through rotors of a screw machine employing the present invention.

In FIG. 1, the numeral 10 generally indicates a screw machine, such as a screw compressor or an expander. The screw machine 10 includes a casing 12 with overlapping bores 12*a* and 12*b* located therein. A female rotor 14 has a pitch circle $P_F$ and is located in the bore 12*a*. A male rotor 16 has a pitch circle $P_M$ and is located in the bore 12*b*. The axes indicated by points A and B are perpendicular to a plane of FIG. 1 and are parallel to each other. The axes A and B are separated by a distance equal to a sum of a radius $R_F$ of the pitch circle $P_F$ of the female rotor 14 and a radius $R_M$ of the pitch circle $P_M$ of the male rotor 16. The axis indicated by point A is the axis of rotation of the female rotor 14 and a center of the bore 12*a* whose diameter generally corresponds to a diameter of the tip circle $T_F$ of the female rotor 14. Similarly, the axis indicated by point B is the axis of rotation of the male rotor 16 and a center of the bore 12*b* whose diameter generally corresponds to the diameter of a tip circle $T_M$ of the male rotor 16.

As illustrated, the female rotor 14 includes six lobes 14*a* (lands) separated by six grooves 14*b*, while the male rotor 16 includes five lobes 16*a* separated by five grooves 16*b*.

Accordingly, the rotational speed of the male rotor 16 will be 6/5 or 120% of that of the female rotor 14. Either the female rotor 14 or the male rotor 16 may be connected to a prime mover (not illustrated) and serve as the driving rotor. Other combinations of the number of female and male lobes and grooves may also be used.

Generally referring to FIG. 1, the major portions of the rotor profile (that is a leading flank or secondary flank D–B for both the male rotor 16 and the female rotor 14 and a trailing flank or primary flank A–E for both the male rotor 16 and the female rotor 14) of the female rotor 14 and the male rotor 16 of the present invention are different ellipses or are generated by different ellipses, with the tip or root portions being circular arcs. The leading flanks D–B and the trailing flanks A–E are relative to the rotary direction of the female rotor 14 and the male rotor 16. Therefore, as shown in FIG. 1, the female rotor 14 rotates clockwise and the male rotor 16 rotates counter-clockwise. As the female rotor 14 and the male rotor 16 rotate, a fluid is compressed or expanded in a chamber between the female rotor 14 and the male rotor 16. The ellipse allows for a continuously changing curved profile, as opposed to a fixed profile with circular curves, yielding a high radius at the drive band for reduced contact stress on the drive band and a low radius near the rotor tip.

With reference to the FIG. 1, a male rotor tip segment $A_M$–$B_M$ and a female rotor root segment $A_F$–$B_F$ are each circular arcs having their centers at the pitch points $P_M$ and $P_F$, respectively. The male rotor tip circle has a tangent contact point with the male tip rotor segment $A_M$–$B_M$ between the points $A_M$ and $B_M$. The female rotor root circle with the root diameter of the female rotor 14 has a tangent contact point with the female tip rotor segment $A_F$–$B_F$ between the points $A_F$ and $B_F$. The male rotor tip segment $A_M$–$B_M$ allows the male tip to have the traditional seal strips or to have the tapered rotors should they are required.

The leading flanks or secondary flanks D–B of the male rotor 16 and the female rotor 14 include two segments. A convex segment $B_M$–$C_M$ is part of an ellipse, with one of its axis overlapped with a line $B_M$–$P_M$ and having a common tangent at a point $B_M$ with the male tip rotor segment $A_M$–$B_M$. A concave or concave-convex segment $B_F$–$C_F$ is conjugally generated by the ellipse convex segment $B_M$–$C_M$. The segment $B_F$–$C_F$ has a common tangent at a point $B_F$ with the circular arc female tip segment $A_F$–$B_F$. Points $C_M$ and $C_F$ may be just on or inside or outside the pitch circles $P_M$ and $P_F$ of the male rotor 16 and the female rotor 14, respectively. A convex segment $C_F$–$D_{1F}$ is part of an ellipse, with one of its axis overlapped with the radius of the segment $D_F$–$D_{1F}$ at a point $D_F$. The segment $C_F$–$D_{1F}$ has a common tangent at the point CF with the segment $B_F$–$C_F$ and has a common tangent at a point $D_{1F}$ with the circular arc segment $D_F$–$D_{1F}$. A concave segment $C_M$–$D_{1M}$ at the male rotor leading flank is conjugally generated by the ellipse convex segment $C_F$–$D_{1F}$ The segment $C_M$–$D_{1M}$ has a common tangent at the point $C_M$ with the convex segment $B_M$–$C_M$ and has a common tangent at a point $D_{1M}$ with a circular arc segment $D_M$–$D_{1M}$.

The tip portion of the female rotor 14 and the root portion of the male rotor 16 include two segments. The segments $D_M$–$D_{1M}$ and $E_M$–$D_M$ are the two segments of the root portion of the male rotor 16, and the segments $D_F$–$D_{1F}$ and $E_F$–$D_F$ are the two segments of the tip portion of the female rotor 14. The segment $D_M$–$D_{1M}$ is a concave circular arc with its center on the pitch circle $P_M$ of the male rotor 16, and the segment $D_F$–$D_{1F}$ is a convex circular arc with its center on the pitch circle $P_F$ of the female rotor 14. The segment $E_M$–$D_M$ is a convex circular arc with its center at the axis A of the male rotor 16, and the segment $E_F$–$D_F$ is a convex circular arc with its center at the axis B of the female rotor 14. The segment $D_M$-$D_{1M}$ has a common tangent at the point DM with the segment $E_M$-DM, and the segment $D_F$–$D_{1F}$ has a common tangent at a point $D_F$ with the segment $E_F$–$D_F$. The female rotor tip segments allow the female tip to have the traditional seal strips or to have the tapered rotors if they are required. The male root segments allow the male root to have the traditional seal grooves.

The trailing or primary flanks A–F of the male rotor 16 and the female rotor 14 include two segments. The segments $A_M$–$F_M$ and $F_M$–$E_M$ are the two segments of the trailing flank A–F of the male rotor 16, and the segments $A_F$–$F_F$ and $F_F$–$E_F$ are the two segments of the trailing flank A–F of the female rotor 14. The convex segment $A_M$–$F_M$ is part of an ellipse, with one of its axis overlapped with a line $A_M$–$P_M$ and having a common tangent at the point $A_M$ with the male rotor tip segment $A_M$–$B_M$. The concave segment $A_F$–$F_F$ is conjugally generated by the ellipse segment $A_M$–$F_M$. The segment $A_F$–$F_F$ has a common tangent at the point $A_F$ with the circular arc female rotor root segment $A_F$–$B_F$. The point $F_F$ is inside the pitch circle $P_F$ of the female rotor 14. The convex segment $F_F$–$E_F$ is part of an ellipse, with one of its axis overlapped with a radius $E_F$–A at the point $E_F$. The segment $F_F$–$E_F$ has a common tangent at a point $F_F$ with the segment $A_F$–$F_F$ and has a common tangent at a point $E_F$ with the circular arc segment $E_F$–$D_F$. The convex-concave segment $F_M$–$E_M$ at the male rotor leading flank D–B is conjugally generated by the ellipse segment $F_F$–$E_F$. The segment $F_M$–$E_M$ has a common tangent at the point $F_M$ with the segment $A_M$–$F_M$ and has a common tangent at the point $E_M$ with the circular arc segment $E_M$–$D_M$.

Figure 2:
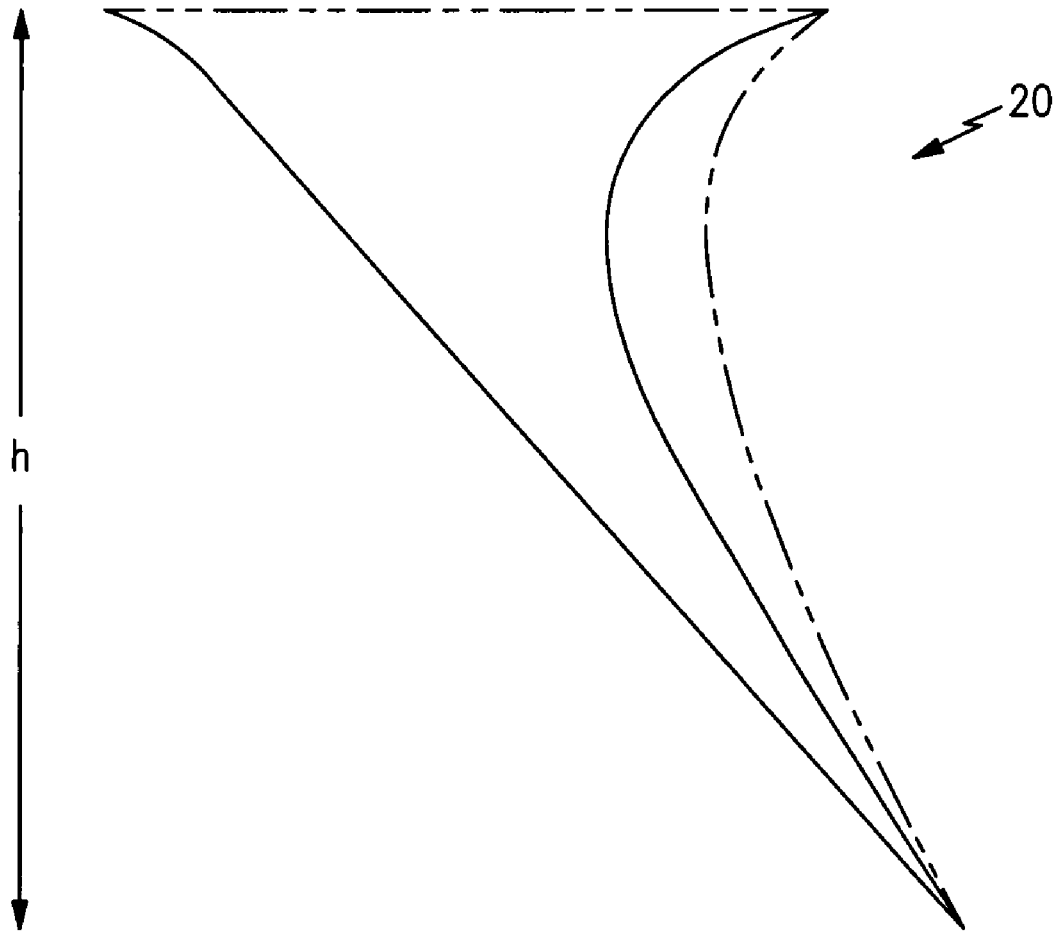
FIG. 2 is a simplified view of a blow hole of the present invention as compared to the prior art.

As illustrated in FIG. 2, as a consequence of the above described profile, the area of a blow hole 20 (shown in solid lines) formed by the tip and leading flank sections of the meshing female rotor 14 and the male rotor 16 is reduced by its shape being curved and narrower, in comparison to prior art blow holes (shown in dashed lines) formed by non-elliptical profiles, without reducing a height h of the blow hole 20. By avoiding reduction in height, reasonable gas torque is maintained from the male rotor 16 to the female rotor 14. As known in the art, the blow hole 20 is a leakage channel which connects the leading and following cavities, and it reduces the total efficiency of helical screw compressor. This design, as described and as shown in FIG. 2, has the advantage of increasing performance of the compressor.

As a further consequence of the above described profile, a contact line length or a seal line length between the male rotor 16 and the female rotor 14 is are reduced. Since the seal line is one of the most important leakage channels inside a helical screw compressor, leading to reduction in both the total efficiency and volumetric efficiency, the reduction of the seal line length has the advantage of increasing performance of the compressor.

As an additional consequence of the above described profile, the drive band between the male rotor 16 and the female rotor 14 experience much lower contact stress. For a male drive screw compressor, if the point $B_M$ of the ellipse segment $B_M$–$C_M$ is located at the long axis of the ellipse, the radius at the point $C_M$ is much larger than the radius at the point $B_M$ due to the geometrical feature of an ellipse. The drive band is located on the segment B–C and near the point C, and the larger radius results in a larger relative radius, which results in lower contact stress. For a female drive screw compressor, the profile section design of segment F–E also gives the profile the ability to control the contact stress at the drive band.

Although preferred embodiments of the present invention have been illustrated and described, other changes will occur to those skilled in the art. It is therefore intended that the scope of the present invention is to be limited only by the scope of the appended claims.

What is claimed is:

1. A conjugate pair of intermeshing rotors comprising:

a female rotor and a male rotor each including helical lobes having helical crests and intervening grooves, wherein the female rotor and the male rotor each rotate about a parallel axis within a working space of a screw rotor machine, and each of the female rotor and the male rotor includes a tip circle, a pitch circle, and a root circle, wherein a major portion of each of the helical lobes of the female rotor is located inside the pitch circle of the female rotor, and a major portion of each of the helical lobes of the male rotor is located outside the pitch circle of the male rotor, wherein the helical lobes of one of the male rotor and the female rotor follows the intervening grooves of the other of the male rotor and the female rotor to form a continuous sealing line between the male rotor and the female rotor, wherein each of the helical lobes have a leading flank portion and a trailing flank portion, wherein the leading flank portion of the helical lobes of the female rotor have a profile formed from at least one ellipse and the leading flank portion of the helical lobes of the male rotor have a profile formed from at least one ellipse, and wherein the trailing flank portion of the helical lobes of at least one of the female rotor and the male rotor has a profile formed from at least one ellipse.

2. The conjugate pair of intermeshing rotors according to claim 1, wherein the leading flank portion of the helical lobes of the female rotor is formed by a first tangent ellipse and a second tangent ellipse and the leading flank portion of the helical lobes of the male rotor is formed by a first tangent ellipse and a second tangent ellipse.

3. The conjugate pair of intermeshing rotors according to claim 1, wherein the trailing flank portion of the helical lobes of both the female rotor and the male rotor have a profile formed from said at least one ellipse.

4. The conjugate pair of intermeshing rotors according to claim 3, wherein the trailing flank portion of the helical lobes of the female rotor is formed by a first tangent ellipse and a second tangent ellipse and the trailing flank portion of the helical lobes of the male rotor is formed by a first tangent ellipse and a second tangent ellipse.

5. The conjugate pair of intermeshing rotors according to claim 1, further including a female root portion between the leading flank portion and the trailing flank portion of the female rotor and a male tip portion between the leading flank portion and the trailing flank portion of the male rotor, wherein both the female root portion and the male tip portion are circular arcs.

6. The conjugate pair of intermeshing rotors according to claim 1, further including a female tip portion between the leading flank portion and the trailing flank portion of the female rotor and a male root portion between the leading flank portion and the trailing flank portion of the male rotor, wherein both the female tip portion and the male root portion are circular arcs.

7. The conjugate pair of intermeshing rotors according to claim 6, wherein the circular arcs are formed of a first circular arc and a second circular arc.

8. The conjugate pair of intermeshing rotors according to claim 1, wherein the trailing flank portion of the helical lobes of both the female rotor and the male rotor have a profile formed from said at least one ellipse, wherein the leading flank portion of the helical lobes of the female rotor is formed by a first tangent ellipse and a second tangent ellipse and the leading flank portion of the helical lobes of the male rotor is formed by a first tangent ellipse and a second tangent ellipse, wherein the trailing flank portion of the helical lobes of the female rotor is formed by a first tangent ellipse and a second tangent ellipse and the trailing flank portion of the helical lobes of the male rotor is formed by a first tangent ellipse and a second tangent ellipse, and wherein a circular arc is defined between the leading flank portion and the trailing flank portion to define one of a tip portion and a root portion.

9. The conjugate pair of intermeshing rotors according to claim 1, wherein the conjugate pair of intermeshing rotors are employed with one of a compressor and an expander.

10. A conjugate pair of intermeshing rotors comprising:

a female rotor and a male rotor each including helical lobes having helical crests and intervening grooves, wherein the female rotor and the male rotor each rotate about a parallel axis within a working space of a screw rotor machine, and wherein each of the female rotor and the male rotor include a tip circle, a pitch circle, and a root circle, wherein a major portion of each of the helical lobes of the female rotor is located inside the pitch circle of the female rotor, and a major portion of each of the helical lobes of the male rotor is located outside the pitch circle of the male rotor, wherein the helical lobes of one of the male rotor and the female rotor follows the intervening grooves of the other of the male rotor and the female rotor to form a continuous sealing line between the male rotor and the female rotor, wherein each of the helical lobes have a leading flank portion and a trailing flank portion, wherein the leading flank portion of the helical lobes of the female rotor have a profile formed from at least one ellipse and the leading flank portion of the helical lobes of the male rotor have a profile formed from at least one ellipse, wherein the trailing flank portion of the helical lobes of the female rotor have a profile formed from at least one ellipse and the trailing flank portion of the helical lobes of the male rotor have a profile formed from at least one ellipse, wherein a female root portion is between the leading flank portion and the trailing flank portion of the female rotor and a male tip portion is between the leading flank portion and the trailing flank portion of the male rotor, wherein both the female root portion and the male tip portion are circular arcs, and wherein a female tip portion is between leading flank portion and the trailing flank portion of the female rotor and a male root portion is between the leading flank portion and the trailing flank portion of the male rotor, wherein both the female tip portion and the male root portion are circular arcs.

11. The conjugate pair of intermeshing rotors according to claim 10, wherein the leading flank portion of the helical lobes of the female rotor is formed by a first tangent ellipse and a second tangent ellipse and the leading flank portion of the helical lobes of the male rotor is formed by a first tangent ellipse and a second tangent ellipse.

12. The conjugate pair of intermeshing rotors according to claim 10, wherein the trailing flank portion of the helical lobes of the female rotor is formed by a first tangent ellipse and a second tangent ellipse and the trailing flank portion of the helical lobes of the male rotor is formed by a first tangent ellipse and a second tangent ellipse.

13. The conjugate pair of intermeshing rotors according to claim 10, wherein the circular arc is formed of a first circular arc and a second circular arc.

14. The conjugate pair of intermeshing rotors according to claim 10, wherein the conjugate pair of intermeshing rotors are employed with one of a compressor and an expander.

* * * * *